US007285013B1

(12) United States Patent
Tabata

(10) Patent No.: US 7,285,013 B1
(45) Date of Patent: Oct. 23, 2007

(54) TERMINAL FITTING, A METHOD OF CRIMPING IT AND A POSITIONING JIG

(75) Inventor: Masaaki Tabata, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/706,497

(22) Filed: Feb. 15, 2007

(30) Foreign Application Priority Data

Feb. 17, 2006 (JP) ..... 2006-041563

(51) Int. Cl.
*H01R 13/40* (2006.01)

(52) U.S. Cl. ..... 439/587

(58) Field of Classification Search ..... 439/587, 439/589, 274, 275, 867, 866
See application file for complete search history.

(56) References Cited

U.S. PATENT DOCUMENTS 5,224,875 A * 7/1993 Watanabe et al. ..... 439/587
5,532,433 A 7/1996 Endo et al.
5,607,318 A * 3/1997 Wakata et al. ..... 439/274
5,897,396 A * 4/1999 Maejima ..... 439/587
6,764,329 B2 * 7/2004 Noguchi et al. ..... 439/273
6,953,365 B2 * 10/2005 Tabata et al. ..... 439/587

FOREIGN PATENT DOCUMENTS

JP 55-96575 7/1980
JP 60-71082 5/1985
JP 5-31144 4/1993
JP 2002-203636 7/2002

* cited by examiner

*Primary Examiner*—Phuong Dinh
(74) *Attorney, Agent, or Firm*—Gerald E. Hespos; Anthony J. Casella

(57) ABSTRACT

A terminal fitting (1) is provided with a rectangular tube (2), a wire barrel (3) and an insulation barrel (4), wherein a pressure portion (16) is arranged between the wire barrel (3) and the insulation barrel (4). The pressure portion (16) includes a pair of coating fixing portions (20) to be arranged at the opposite sides of a coating portion (10) exposed between an exposed core (11) of a wire (W) and a rubber plug (12), and the coating portion (10) is fastened by both coating fixing portions (20). Since the coating fixing portions (20) are provided to cause a fastening force to directly act on the coating portion (10) of the wire (W) without via a rubber plug fixing portion (13) of the rubber plug (12) in this way, a wire fastening force can be increased.

13 Claims, 13 Drawing Sheets

TERMINAL FITTING, A METHOD OF CRIMPING IT AND A POSITIONING JIG

BACKGROUND OF THE INVENTION

1. Field of the Invention

The invention relates to a terminal fitting, a method of crimping it and a positioning jig.

2. Description of the Related Art

Japanese Unexamined Patent Publication No. 2002-203636 discloses a terminal fitting used with a wire and a rubber plug in a watertight connector. A wire insertion hole penetrates the rubber plug longitudinally for receiving the wire, and a fixing portion is formed on the outer circumferential surface of the rubber plug near one longitudinal end. The terminal fitting has a wire barrel to be crimped into connection with a core of a wire and an insulation barrel to be crimped into connection with both an insulation coating of the wire and the fixing portion of the rubber plug.

A fastening force of the insulation barrel of the terminal fitting acts indirectly via the rubber plug. Thus, the fastening force may not be transmitted sufficiently to the wire and a connecting force may be insufficient. Tensile stress concentrates on the core fixed by the wire barrel if the wire is pulled in this state. The strength of core is reduced as the wire becomes thinner and the core may fracture. The fastening force of the insulation barrel may be increased as a countermeasure. However, this may crack the rubber plug.

The invention was developed in view of the above problem and an object thereof is to improve a fastening force.

SUMMARY OF THE INVENTION

The invention relates to a terminal fitting to be used with a wire and a resilient plug. The wire has a conductive core and an insulating coating surrounding the core. A portion of the insulating coating near an end of the wire is removed to expose the core. The plug is mounted over the coating near the exposed core. The terminal fitting has a terminal connecting portion to be connected with a mating terminal. The terminal fitting also has a wire barrel to be crimped, bent or folded into connection with the core of the wire and an insulation barrel to be crimped, bent or folded into connection with the plug. A coating fixing portion is between the wire barrel and the insulation barrel and aligns with an area of the coating exposed between the exposed core and the plug. The coating fixing portions are configured to squeeze and deform the coating. Accordingly, a fastening force acts directly on the coating.

At least two coating fixing portions may be formed between the wire barrel and the insulation barrel at opposite sides of the portion of the coating exposed between the exposed core and the plug.

The coating fixing portion preferably is dimensioned to enclose the coating at least over substantially half the circumference. Accordingly, a maximum bulging portion passing the center of the coating can be squeezed.

The coating fixing portions may be coupled to one or both barrels and can be crimped, bent or deformed into engagement with the coating as one or both barrels are crimped, bent or deformed. Accordingly, the coating fixing portions need not be crimped separately and an operation step is omitted.

The coating fixing portions preferably are opposed and are spaced apart by a distance smaller than the outer diameter of the coating. The coating portion is pressed into a clearance between the coating fixing portions before one or both barrels are crimped. Accordingly, the wire is positioned by the coating fixing portions and the barrels can be crimped, bent or folded stably.

The coating fixing portions preferably include at least one projection to project substantially towards the coating. Accordingly, the projection bites into the coating to increase the fastening force further.

The projection preferably has at least one surface at an angle, preferably substantially perpendicular to a wire pulling direction. Accordingly, a connecting force against a wire pulling force is increased.

The invention also relates to a positioning jig with an accommodating portion for accommodating a resilient plug. A wire insertion hole penetrates the plug longitudinally. The jig has plug stopper for positioning the plug in the accommodating portion, and a wire stopper for positioning a wire inserted in the wire insertion hole. The positioning jig is designed to fix an insertion depth of the wire into the plug. Accordingly, the wire and the plug can be positioned easily before using the terminal fitting. Further, the coating of a specified length can be exposed between the core and the plug by exposing the core by a specified distance near the end of the wire.

Features of the invention will become more apparent upon reading the following description of preferred embodiments. Even though embodiments are described separately, features may be combined

DETAILED DESCRIPTION OF THE PREFERRED EMBODIMENTS

A terminal fitting according to first embodiment of the invention is identified by the numeral 1 in FIGS. 1 to 7 and 11. In the following description, a connection side with a mating terminal fitting (left side in FIG. 6) is referred to as the front concerning forward and backward directions FBD and reference is made to FIG. 3 concerning vertical direction.

Figure 11:
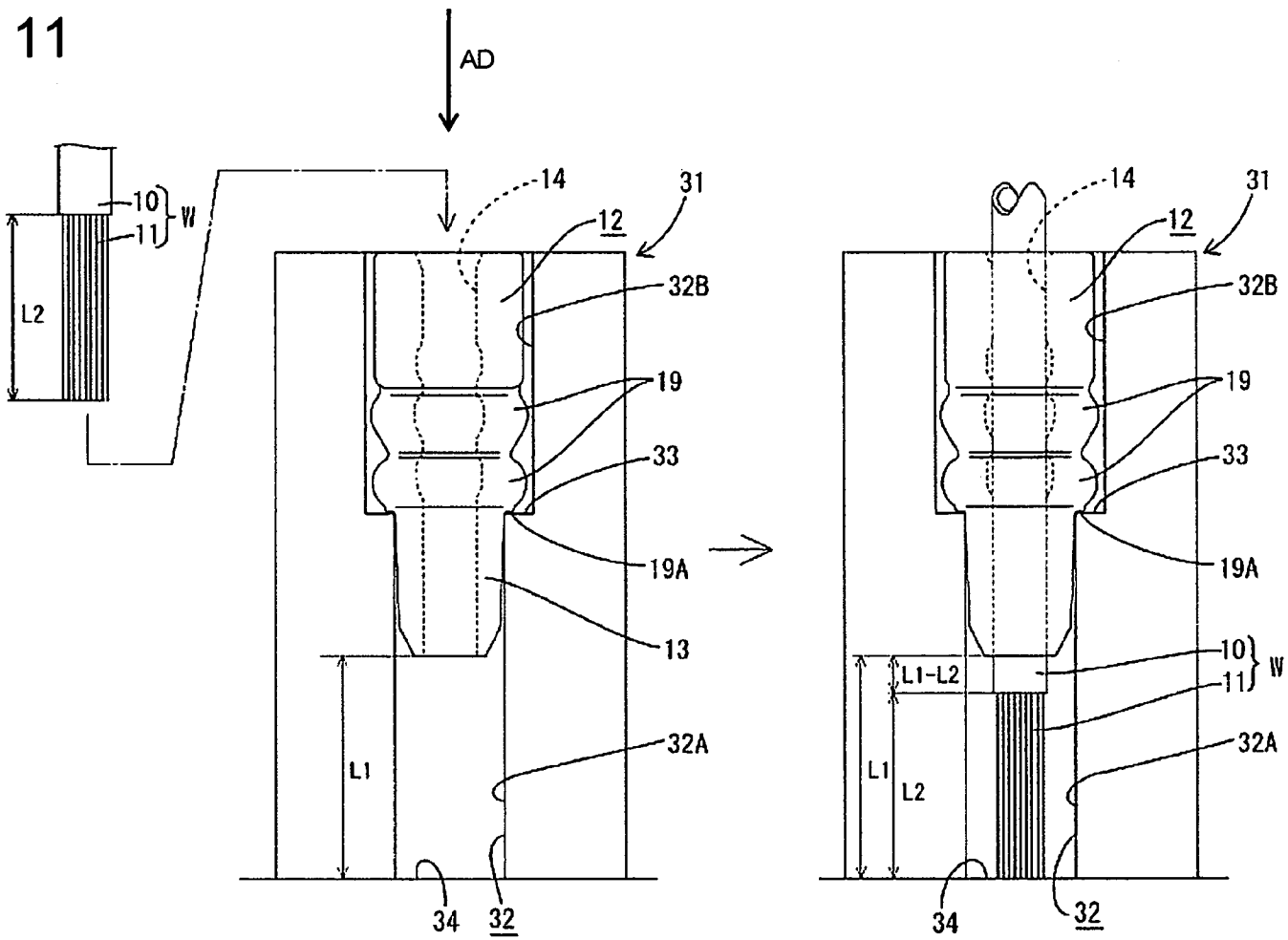
FIG. 11 is front views showing a positioning procedure using a positioning jig.

The terminal fitting 1 is used with a plug 12 made of rubber or other resilient material. The material of the plug 12 is selected to achieve fluid-tightness. As shown in FIG. 11, the plug 12 is a tube with a wire insertion hole 14 that penetrates the plug 12 in forward and backward directions FBD and is dimensioned to engage the outer circumferential surface of the wire W. An end of a wire W is insertable into the wire insertion hole 14 from behind the rubber plug 12 and along a wire insertion direction. A fixing portion 13 is defined near the front end of the rubber plug 12 and has a smaller outer dimension than other parts of the plug 12. Circumferential lips 19 project out at positions behind the fixing portion 13. The lips 19 closely contact the inner peripheral surface of an unillustrated plug mount hole when the terminal fitting 1 is inserted into a cavity of an unillustrated connector to achieve fluid tightness between the plug 12 and the cavity. A front periphery 13A of the fixing portion 13 is tapered towards the leading end.

Figure 1:
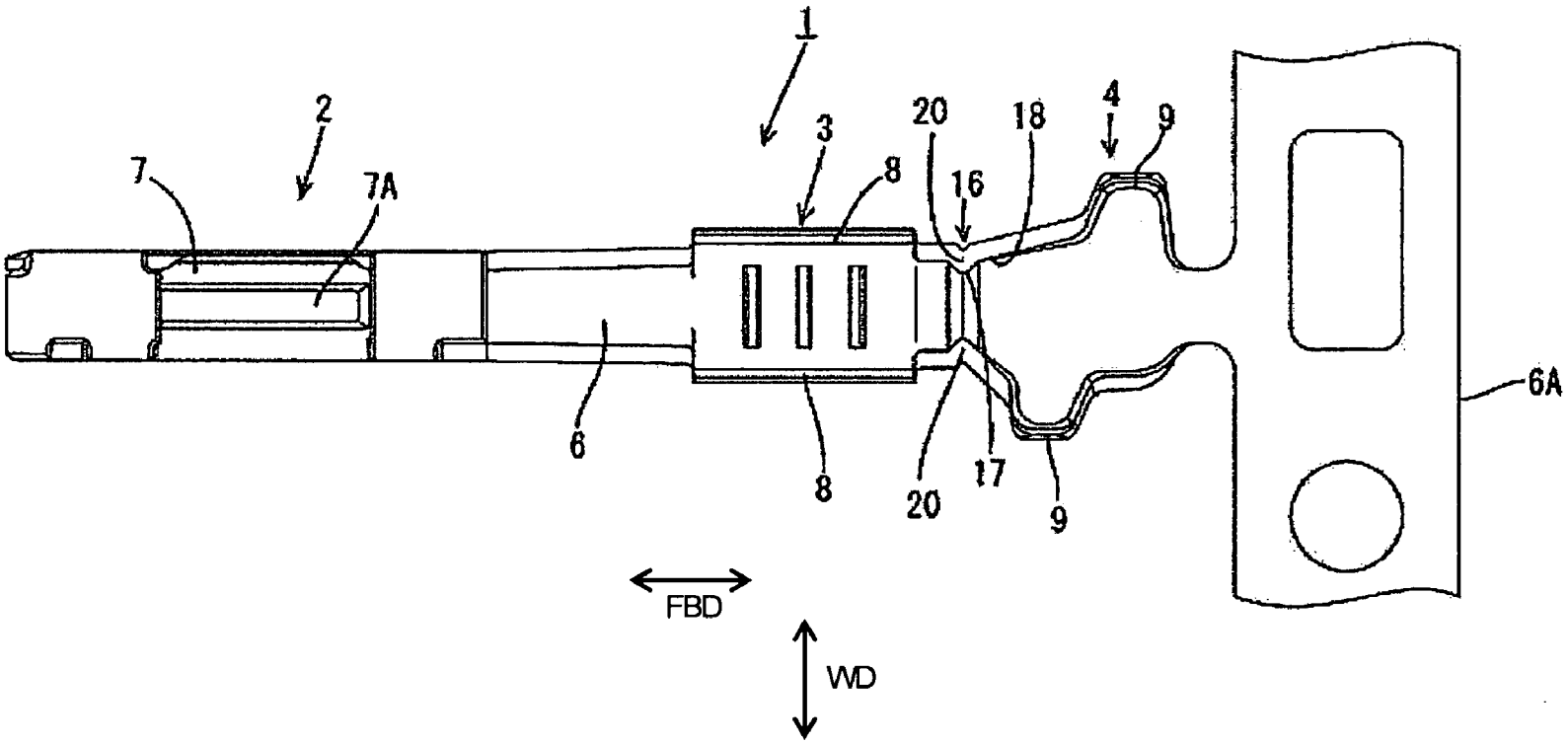
FIG. 1 is a plan view showing only a terminal fitting of a first embodiment before crimping.
Figure 2:
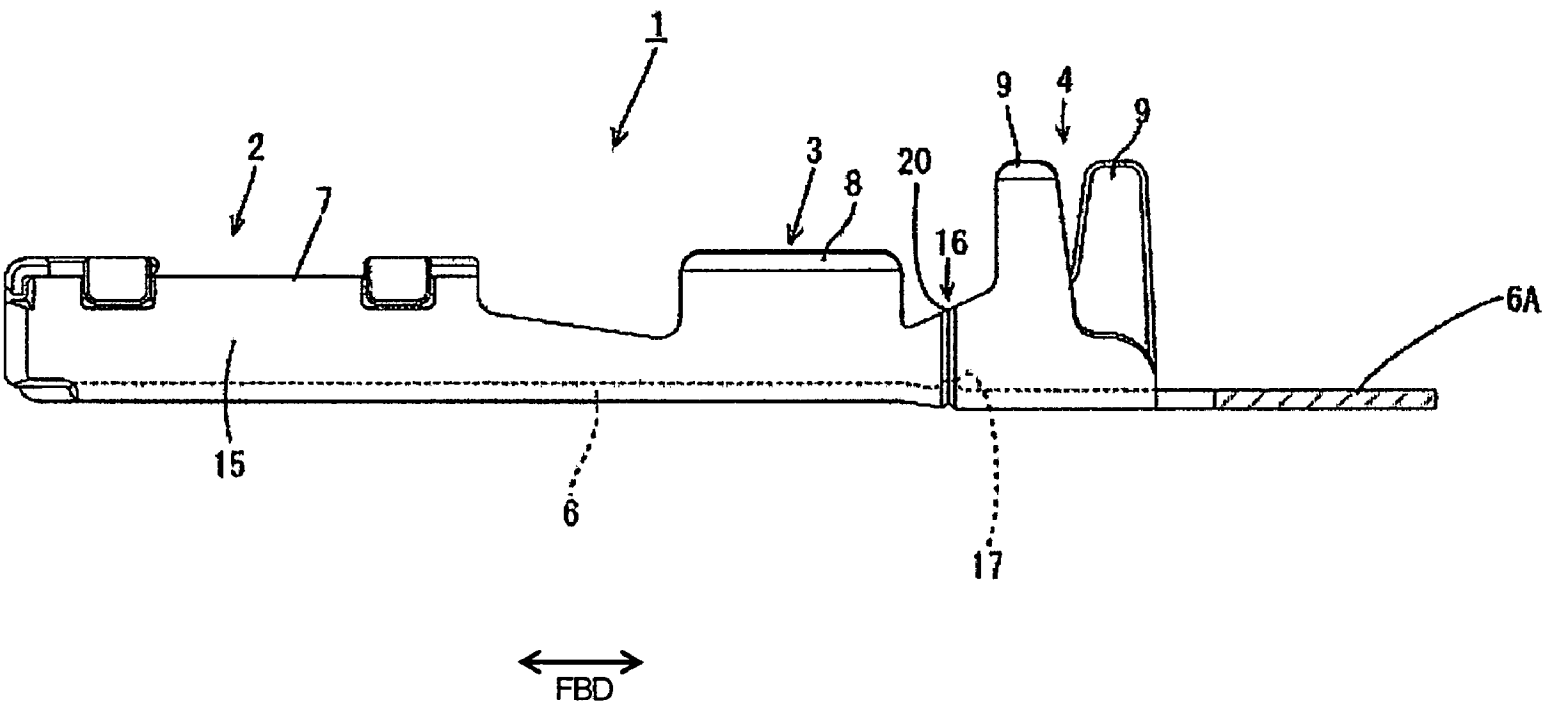
FIG. 2 is a side view of the terminal fitting.

The terminal fitting 1 is formed by bending, folding and/or embossing a punched or cut conductive metal sheet. As shown in FIG. 1, plural terminal fittings 1 are coupled via a carrier 6A and are formed simultaneously when the conductive sheet is punched or cut and before the wire W is fastened. As shown in FIG. 2, a bottom plate 6 extends in forward and backward directions FBD in the same plane as the carrier 6A, and the carrier 6A extends substantially normal to the forward and backward directions FBD. The terminal fitting 1 has a rectangular tube 2, a wire barrel 3 and an insulation barrel 4 arranged in this order from the front of the terminal fitting 1. The tube 2 is configured for connection with an unillustrated mating terminal. The wire barrel 3 is to be crimped into connection with a portion of the core 11 of the wire W exposed by stripping the insulation coating 10 at an end of the wire W. The insulation barrel 4 is crimped into connection with the insulation coating 10 of the wire W together with the rubber plug 12 mounted on the coating 10 at a position substantially adjacent to the exposed core 11.

Figure 3:
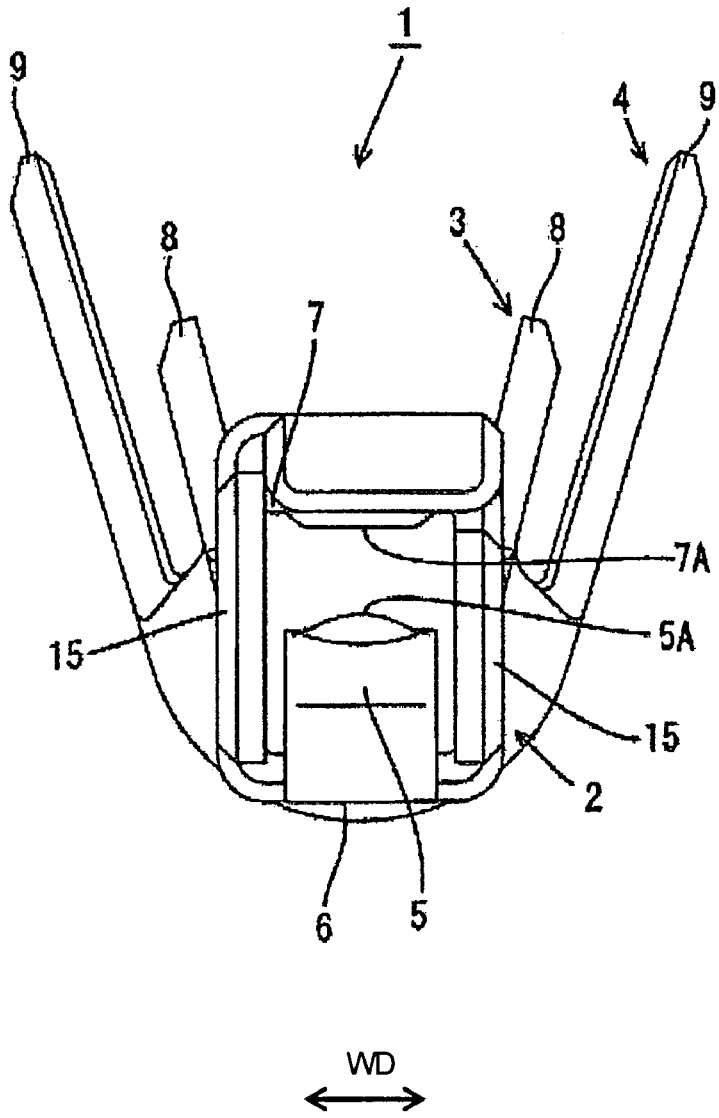
FIG. 3 is a front view of the terminal fitting.

The rectangular tube 2 is hollow in forward and backward directions FBD, as shown in FIG. 3 and has two opposed side walls 15 that project up from opposite sides of the bottom plate 6. Two ceiling plates 7 are placed one over the other by folding upper parts of each side wall 15 towards the other side wall 15. The outer ceiling plate 7 is divided into front and rear sections by having a part of a specified length in forward and backward directions FBD cut over substantially the entire width. One side wall 15 has cutouts, and parts of the outer ceiling plate 7 are bent to fit into the cutouts of the side wall 15.

A resiliently deformable tongue 5 is folded back from the front edge of the bottom plate 6 and into the rectangular tube 2. As shown in FIG. 3, the tongue 5 has a contact point 5A at its top inner part, whereas the inner ceiling plate 7 substantially facing the contact point 5A in the rectangular tube 2 is embossed to form an inwardly projecting contact protrusion 7A. The spacing between the contact point 5A and the contact protrusion 7A is less than the thickness of a male tab of an unillustrated mating terminal. The male tab can be inserted into the rectangular tube 4 from the front and is held resiliently between the contact point 5A and the contact protrusion 7A to connect the two terminal fittings electrically.

Figure 4:
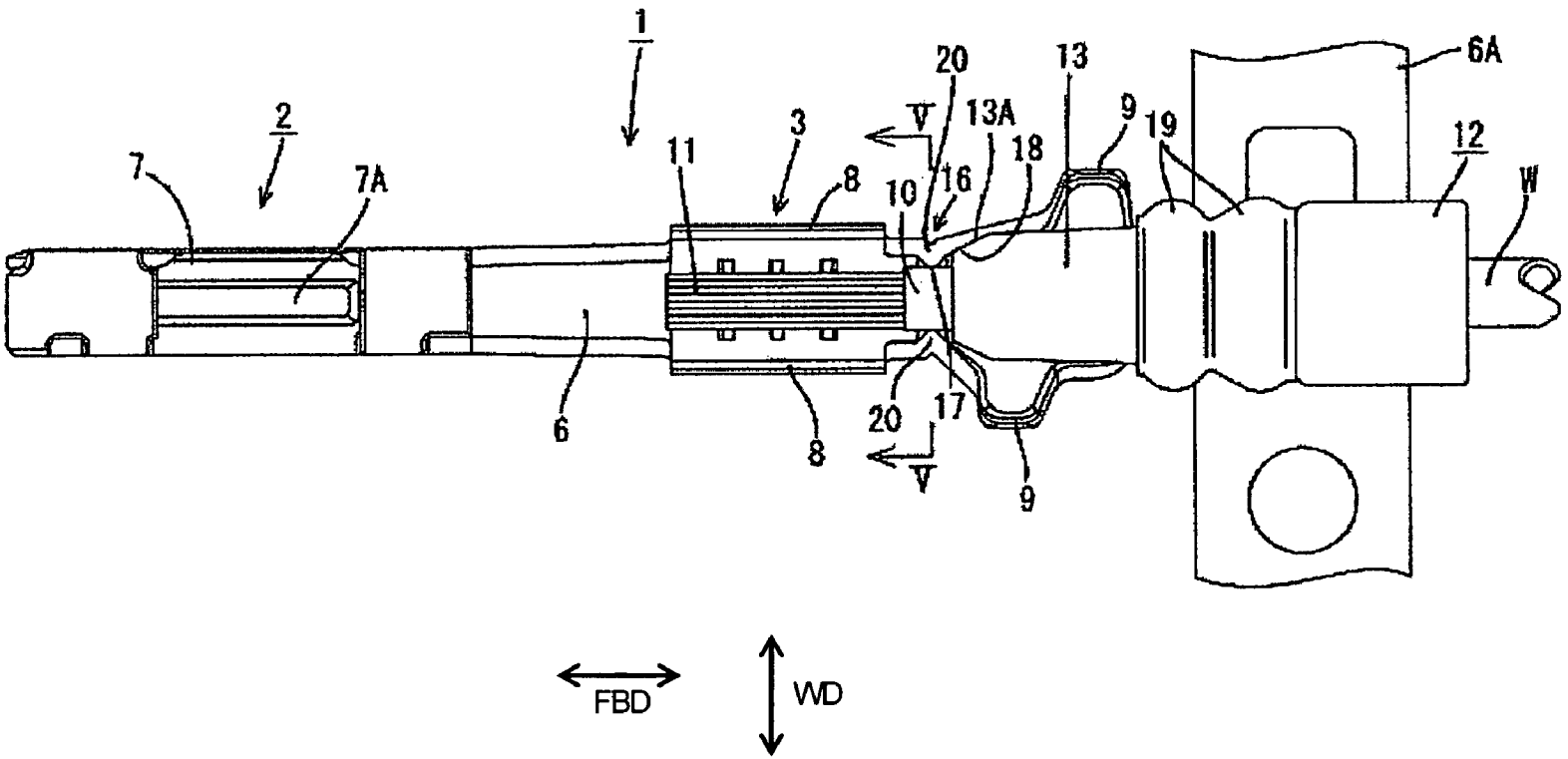
FIG. 4 is a plan view of the terminal fitting having a rubber plug and a wire mounted before crimping.
Figure 5:
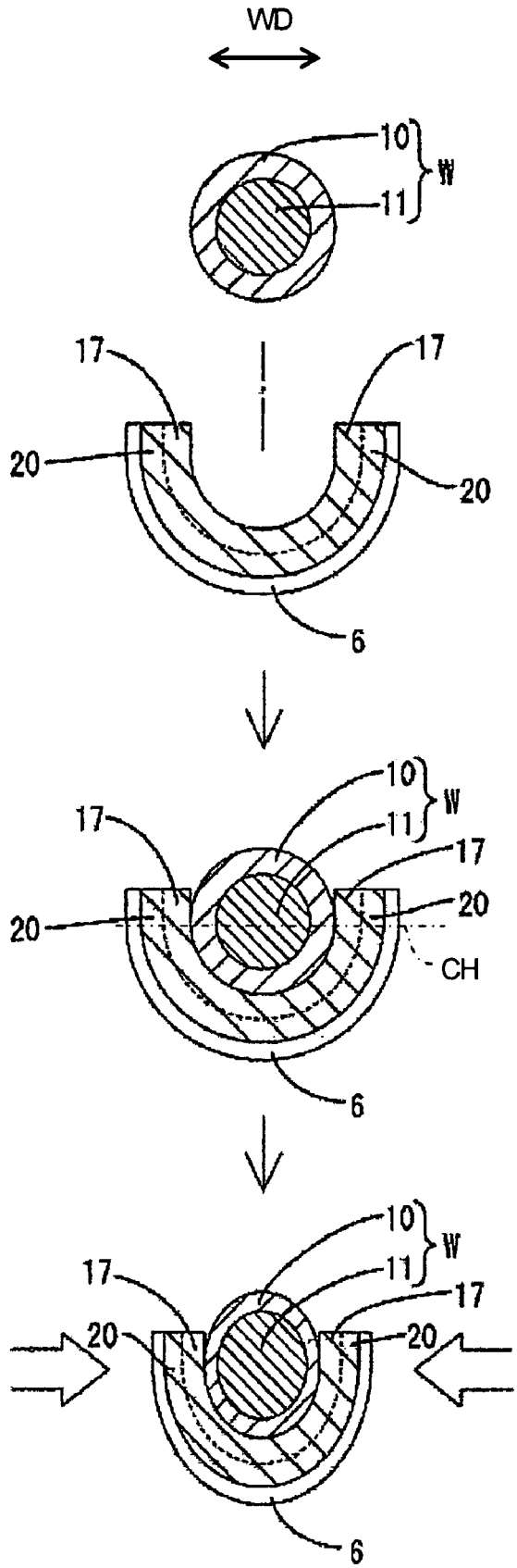
FIG. 5 is sections along V-V of FIG. 4 showing the procedure of crimping the wire.
Figure 6:
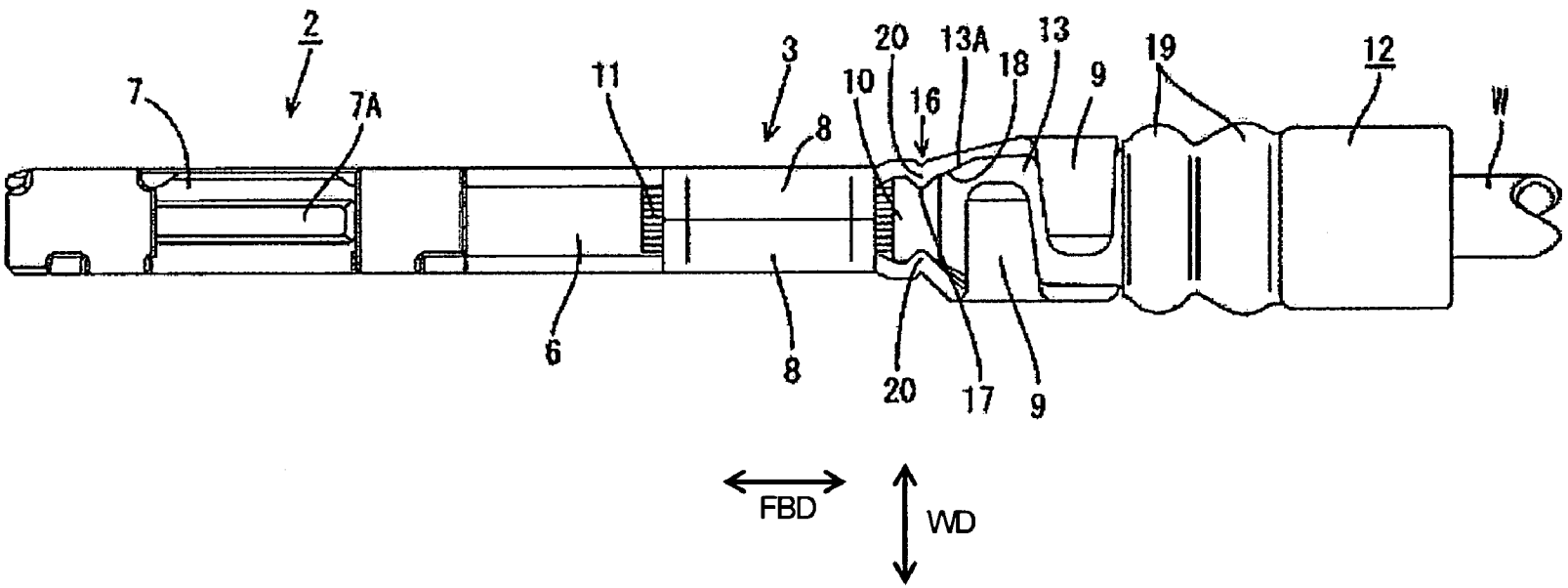
FIG. 6 is a plan view showing the terminal fitting having the rubber plug and the wire mounted after crimping.
Figure 7:
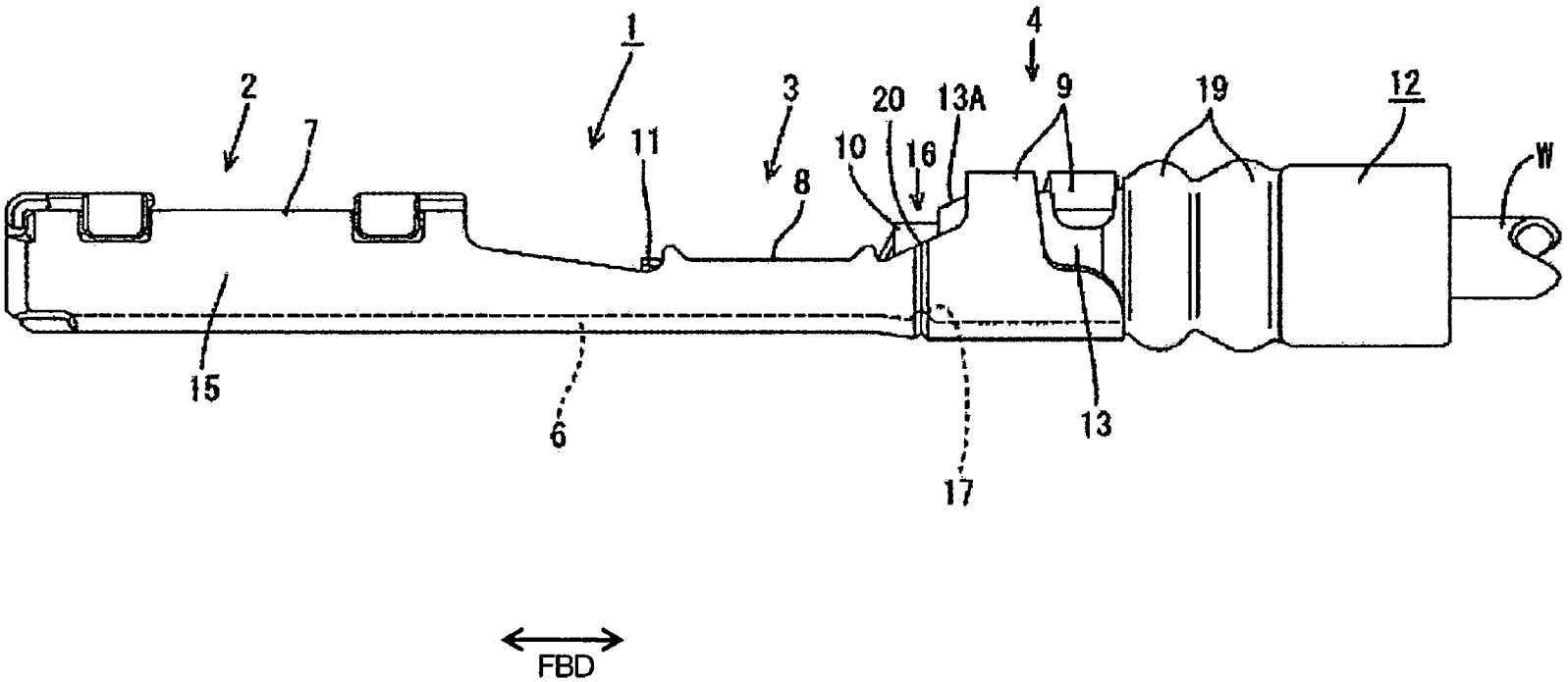
FIG. 7 is a side view of the terminal fitting of FIG. 6.

As shown in FIG. 2, the wire barrel 3 is behind the rectangular tube 2 at a specified distance therefrom. The wire barrel 3 is substantially U- or V-shaped when viewed from the front before the wire W is mounted, as shown in FIG. 3, and includes crimping pieces 8. The crimping pieces project from the bottom plate 6 and face each other in the width direction WD. The length of the crimping pieces 8 along the forward and backward directions FBD is substantially equal to or slightly shorter than the length of the exposed core 11, as shown in FIG. 4. The wire W and the terminal fitting 1 are electrically connected by crimping, bending or folding both crimping pieces 8 into contact with the exposed core 11, as shown in FIG. 6.

The insulation barrel 4 is behind the wire barrel 3. As shown in FIG. 3, the insulation barrel 4 is substantially U- or V-shaped when viewed from the front before the wire W is mounted, and includes two barrel pieces 9 that project from the bottom plate 6 a distance longer than a projecting distance of the crimping pieces 8 (see e.g. FIG. 2). As shown in FIG. 4, the two barrel pieces 9 are displaced in forward and backward directions FBD to avoid mutual interference during crimping. The barrel pieces 9 are crimped into connection with the fixing portion 13 of the rubber plug 12 to fix the insulation coating 10 of the wire W and the rubber plug 12.

A pressure portion 16 is arranged between the wire barrel 3 and the insulation barrel 4. As shown in an upper part of FIG. 5, the pressure portion 16 includes two coating fixing portions 20 that project up from the bottom plate 6 while facing each other. The coating fixing portions 20 are arranged at the opposite sides of the insulation coating 10 exposed between the exposed core 11 and the rubber plug 12 before crimping, as shown in a middle part of FIG. 5. The coating fixing portions 20 are coupled to lower parts of both barrels 3, 4 for movement together, as shown in FIG. 2. In other words, the coating fixing portions 20 are pushed in as the crimping pieces 8 and/or the barrel pieces 9 are deformed in during the crimping of both barrels 3, 4. Further, the coating fixing portions 20 are formed so that their heights from the bottom plate 6 gradually increases from the vertical rear edge of the wire barrel 3 towards the vertical front edge of the insulation barrel 4 along the forward and backward directions FBD. As shown in FIG. 4, the front ends of the coating fixing portions 20 are before the front edge of the insulation coating 10 and the rear ends thereof reach the plug fixing portion 13. It should be noted that the terminal fitting 1 may be cut off from the carrier 6A at the time of crimping (see FIG. 6).

The pressure portion 16 is embossed from the outer side to form a projection 17 that projects circumferentially on the inner surface of the pressure portion 16. The projection 17 is in an intermediate longitudinal position of that part of the insulation coating 10 exposed forward of the rubber plug 12, as shown in FIG. 4, and extends circumferentially to a position higher than a center height CH of the center of the wire W before crimping, as shown in the middle part of FIG. 5. In other words, the circumferential length of the projection 17 is greater than half of the circumference of the wire W. A distance between the tip of the projection 17 at one side and that at the opposite side before crimping is substantially equal to or slightly larger than the outer diameter of the insulation coating 10. In other words, the projection 17 has a height to enclose the coating 10 over more than half the circumference before crimping. Thus, the projection 17 bites in the coating 10 as the barrels 3, 4 are crimped, as shown in a bottom part of FIG. 5, so that a fastening force can be increased. A tapered contact surface 18 is formed on the inner circumferential surface of the pressure portion 16 behind the projection 17 and is widened towards the back. The front periphery 13A of the fixing portion 13 of the rubber plug 12 contacts the contact surface 18, so that the mounted wire W having the rubber plug mounted can be positioned with respect to forward and backward directions.

A specified length of the insulation coating is stripped near the end of the wire W to expose the core 11. The end of the wire W is inserted into the wire insertion hole 14 of the plug 12 from behind, to expose the coating 12 of the specified length between the core 11 and the plug 12 using, for example, a positioning jig. Subsequently, the front periphery 13A of the fixing portion 13 contacts the contact surface 18 to set the wire W in the terminal fitting 1 (see FIG. 4). In this state, the crimping pieces 8 are laterally at opposite sides of the core 11, the barrel pieces 9 are laterally at the opposite sides of the fixing portion 13 of the plug 12, and the coating fixing portions 20 are arranged laterally at the opposite sides of the insulation coating 10 exposed between the exposed core 11 and the plug 12.

The barrels 3, 4 then are crimped and the pressure portion 16 is crimped with the barrels 3, 4. The core 11 is fastened by the crimping pieces 8 of the wire barrel 3, the plug fixing portion 13 of the plug 12 and the insulation coating 10 therein are fastened by the barrel pieces 9 of the insulation barrel 4, and the coating 10 exposed between the exposed core 11 and the rubber plug 12 is fastened by the projection 17 of the pressure portion 16 (see FIG. 6). The terminal fitting 1 is cut off from the carrier 6A as or after they are fastened.

As described above, the coating fixing portions 20 are provided between the barrels 3, 4 and are crimped into connection with the insulation coating 10 without interposition of the plug 12. Thus, the fastening force acts directly act on the wire W. Further, the coating fixing portions 20 are coupled to both barrels 3, 4 for movement together with the barrels 3, 4. Thus, the coating 10 is fastened as the barrels 3, 4 are crimped. Accordingly, the coating fixing portions 20 need not be crimped separately, and one operation step can be omitted. In addition, the fastening force is improved by the biting of the projection 17 of the coating fixing portions 20 into the coating 10.

Figure 8:
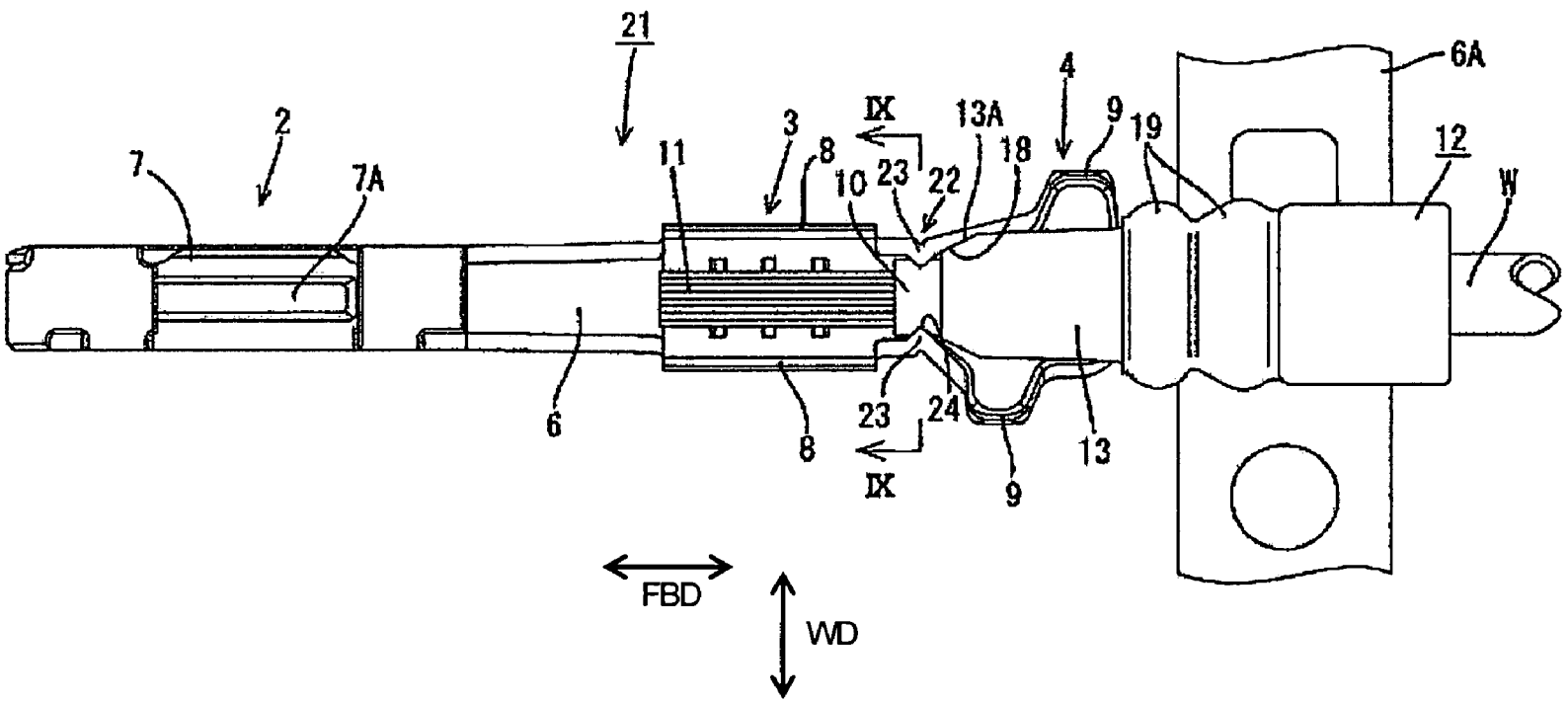
FIG. 8 is a plan view showing only a terminal fitting of a second embodiment before crimping.
Figure 9:
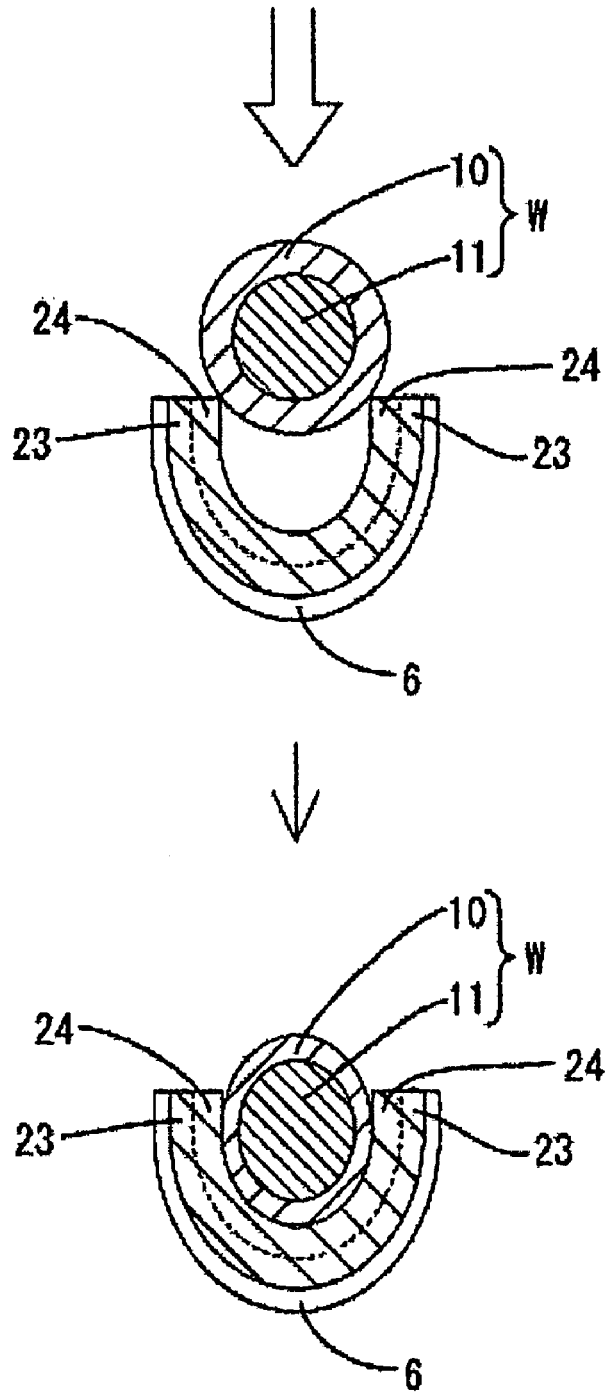
FIG. 9 is sections along IX-IX of FIG. 8 showing the procedure of pressing the wire into a pressure portion.
Figure 10:
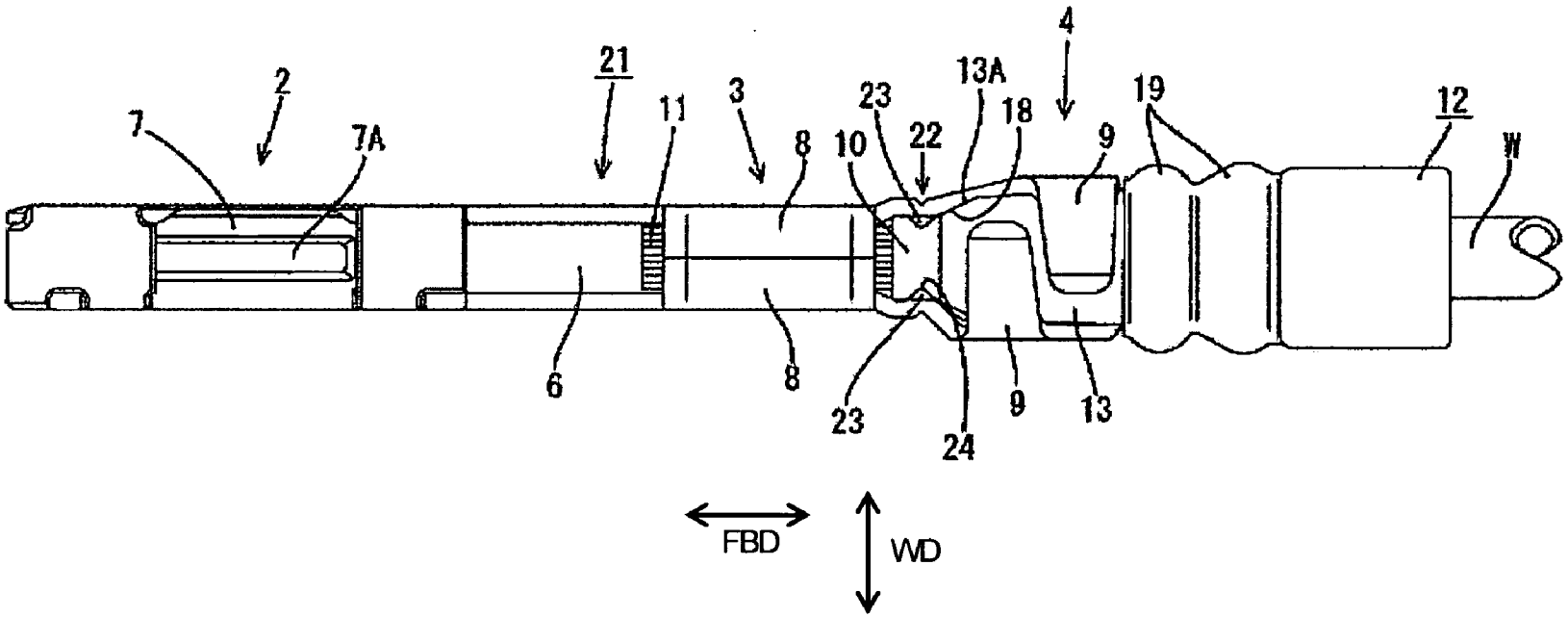
FIG. 10 is a plan view showing the terminal fitting having the rubber plug and the wire mounted after crimping.

A terminal fitting according to a second embodiment of the invention is identified by the numeral 21 in FIGS. 8 to 10. The terminal fitting 21 has a pressure portion 16 that differs from the first embodiment. Other elements, however, are the same and are not described again. The terminal fitting 21 has a pressure portion 22 with two coating fixing portions 23 that are substantially opposed to each other while being spaced apart by a distance smaller than the outer diameter of the insulation coating 10, as shown in FIG. 8. The insulation coating 10 can be pressed into a clearance between the coating fixing portions 23 before crimping the barrels 3, 4 (see FIG. 9). The pressure portion 22 is embossed from the outer side to form a projection 24 projecting along the circumferential direction on the inner periphery thereof. The barrels 3, 4 are crimped after the coating 10 is fixed by the projection 24, as shown in FIG. 10. Thus, the connection of the wire W, the plug 12 and the terminal fitting 21 is completed and the terminal fitting 21 is cut off from the carrier 6A. Accordingly, the wire W can be positioned before crimping the barrels 3, 4 and the barrels 3, 4 can be crimped stably since the wire W is fixed by the projection 24 of the coating fixing portions 23. The coating fixing portions 23 may be coupled to the barrels 3, 4 as to be movable together or may not be so coupled.

Figure 12:
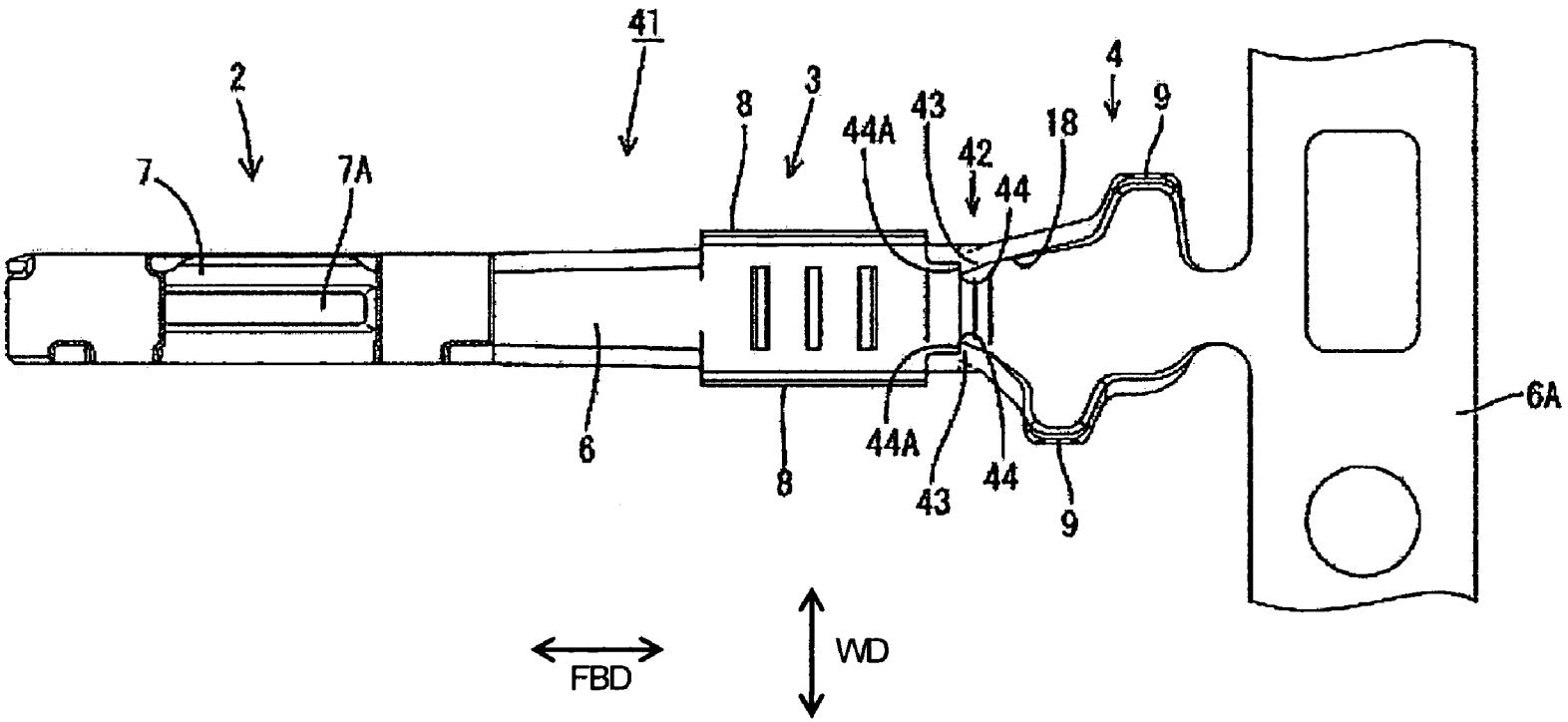
FIG. 12 is a plan view showing only a terminal fitting of a third embodiment before crimping.
Figure 13:
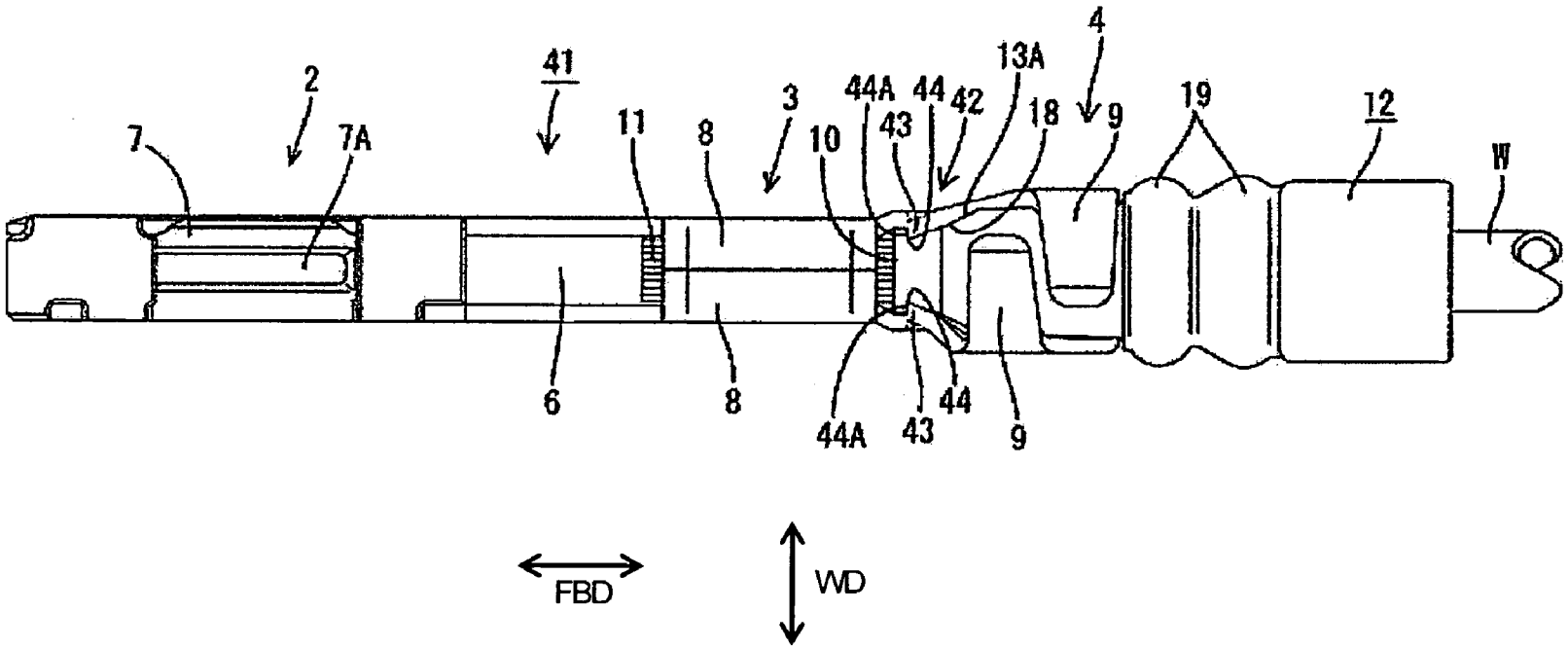
FIG. 13 is a plan view showing the terminal fitting having the rubber plug and the wire mounted after crimping.

A terminal fitting according to a third embodiment of the invention is identified by the numeral 41 in to FIGS. 12 and 13. The terminal fitting 41 has a projection that differs from the projections of the first and second embodiments. Other elements, however, are substantially the same, and are not described again. Specifically, the terminal fitting 41 has a pressure portion 42 with two coating fixing portions 43. As shown in FIG. 12, the coating fixing portions 43 are substantially opposed to each other and the pressure portion 42 is embossed from the outer side to form a projection 44 projecting in along the circumferential direction on the inner surface thereof. The space between the two coating fixing portions 43 is smaller than the outer diameter of the insulation coating 10 of the wire W. Thus, the coating 10 of the wire W can be fixed by being pressed into the pressure portion 42. If this spacing is substantially equal to or slightly larger than the outer diameter of the coating 10 of the wire W, the coating 10 of the wire W can be fixed by crimping the barrels 3, 4 and the coating fixing portions 43. The projection 44 has a forwardly facing perpendicular surface 44A substantially perpendicular to the longitudinal direction of the terminal fitting 41 (wire pulling direction) and the forward and backward direction FBD. The perpendicular surface 44A is formed by cutting an inclined surface at a side toward the wire barrel 3 at least partly along circumferential direction near the tip of the projection 44. The coating 10 is pressed into the coating fixing portions 43 and fixed by the projection 44 and by crimping. Thus, the connection of the wire W, the rubber plug 12 and the terminal fitting 41 is completed and the terminal fitting 41 is cut off from the carrier 6A. Accordingly, even if the wire W is pulled, there is no slipping between the perpendicular surface 44A of the projection 44 and the coating 10, i.e. the coating 10 held substantially in contact with the perpendicular surface 44A of the projection 44 produces substantially no component of force in a direction to escape toward the tip of the projection 44. Therefore, the connecting force of the wire W against a pulling force can be improved. The coating fixing portions 43 may be coupled to the barrels 3, 4 as to be movable together or may not be so coupled.

A positioning jig 31 for fixing an insertion depth of a wire W into the rubber plug 12 is described with reference to FIG. 11. The positioning jig 31 includes an accommodating chamber 32 for accommodating the plug 12, a plug stop 33 for positioning the plug 12 in the accommodating portion 32, and a wire stop 34 for positioning the wire W in the wire insertion hole 14 of the plug 12. The accommodating chamber 32 has a first accommodating portion 32A for accommodating the fixing portion 13 of the plug 12 and a second accommodating portion 32B for accommodating a remaining part of the plug 12 including the lips 19.

An opening is formed at an end of the second accommodating portion 32B, and the rubber plug 12 can be inserted into the accommodating chamber 32 through this opening. Further, an end of the first accommodating portion 32A is closed where the wire stop 34 is formed. The first accommodating portion 32A is narrower than the second accommodating portion 32B and has substantially the same width as the outer diameter of the plug fixing portion 13. On the other hand, the second accommodating portion 32B is slightly wider than the outer diameter of the lips 19. The plug stop 33 is formed between the two accommodating portions 32A, 32B and is substantially normal to an accommodating direction AD of the plug 12. The plug stopper 33 engages a step 19A between the plug fixing portion 13 and the lips 19 to position the rubber plug 12. Thus, the plug 12 is inserted into the second accommodating portion 32B so that the plug fixing portion 13 enters the first accommodating portion 32A and remaining parts of the plug 12 including the lips 19 are accommodated into the second accommodating portion 32B. As a result, the step 19A engages the plug stop 33 and the plug 12 is positioned in the accommodating chamber 32. In this state, the end of the plug fixing portion 13 of the plug 12 and the wire stopper 34 are spaced apart by a specified distance L1 (see left side of FIG. 11). Subsequently, an end of a wire W is inserted into the wire insertion hole 14 and the leading end thereof is brought into contact with the wire stopper 34. Accordingly, the wire W projects from the plug 12 by the specified distance L1 between the stopper 34 and the end of the plug fixing portion 13 of the plug 12. By using the wire W in which a core 11 is exposed by a specified distance L2 (L1-L2) in the end portion of the wire W, the coating 10 can be exposed by a specified distance (L1-L2) between the exposed core 11 and the rubber plug 12. Accordingly, the wire W and the plug 12 can be positioned easily before using the terminal fitting.

The invention is not limited to the above-described embodiments. For example, the following embodiments also are embraced by the invention as defined by the claims, and still other changes can be made without departing from the scope and spirit of the invention as defined by the claims.

Although female terminal fittings are illustrated in the foregoing embodiments, the invention is also applicable to male terminal fittings.

The coating fixing portions 20 need not be coupled to both barrels 3, 4, as in the first embodiment. The coating fixing portions 20 may be coupled to neither of the barrels 3, 4 or may be coupled to one of the two barrels 3, 4.

The projection extends circumferentially on the inner surface of the pressure portion in the foregoing embodiments. However, the projection need not be formed circumferentially. For example, substantially conical projections may be arranged at intervals on the inner surface of the pressure portion.

The insertion depth of the wire W into the rubber plug 12 is fixed by the positioning jig in the foregoing embodiments. However, positioning need not be performed by the positioning jig. For example, a wire stopper may formed by cutting and bending part of the bottom plate 6 before the wire barrel 3, and the contact surface 18 may function as a rubber plug stopper. Specifically, the end of the wire W is inserted slightly into the wire insertion hole 14 of the plug 12, the front periphery 13A of the plug fixing portion 13 is brought into contact with the contact surface 18 to position the rubber plug 12, and the end of the wire W is pushed into contact with the wire stopper to position the wire W and to fix the insertion depth of the wire W.

What is claimed is:

1. A terminal fitting, comprising:

a terminal connecting portion configured for connection with a mating terminal;

a wire barrel configured for crimped connection with a core of a wire exposed adjacent an end of the wire;

an insulation barrel disposed and configured for crimped connection with both insulation coating of the wire and a resilient plug on the insulation coating in proximity to the exposed core; and at least one fixing portion between the wire barrel and the insulation barrel, the fixing portion being arranged near a portion of the insulation coating exposed between the exposed core and the resilient plug and being configured for squeezing and fixing the insulation coating.

2. The terminal fitting of claim 1, wherein the fixing portion is configured for engaging opposite sides of the insulation coating exposed between the exposed core and the resilient plug.

3. The terminal fitting of claim 1, wherein the fixing portion is configured to enclose at least half of a circumference of the insulation coating.

4. The terminal fitting of claim 1, wherein the fixing portion is coupled to at least one of the barrels for movement with at least one of the barrels as the barrels are crimped.

5. The terminal fitting of claim 4, wherein the fixing portion has opposed parts spaced apart by a distance smaller than an outer diameter of the insulation coating so that the insulation coating is pressed into a clearance between the fixing portions before the barrels are crimped.

6. The terminal fitting of claim 1, wherein the fixing portion has at least one projection projecting towards the coating.

7. The terminal fitting of claim 6, wherein the projection has a surface substantially perpendicular to a wire pulling direction.

8. A terminal assembly, comprising:

a wire having first and second ends, a core extending from the first end towards the second end, and an insulation coating surrounding portions of the core spaced a selected distance from the first end to define an exposed section of the core adjacent the first end;

a resilient plug mounted over the insulation coating of the wire a selected distance from the first end of the wire so that a length of the insulation coating is exposed between the resilient plug and the exposed section of the core;

a terminal fitting having a terminal connecting portion configured for connection with a mating terminal, a wire barrel crimped into connection with the exposed section of the core of the wire, an insulation barrel crimped into connection with the resilient plug, and a projection engaging a portion of the insulation coating exposed between the exposed section of the core and the resilient plug.

9. The terminal assembly of claim 8, wherein the projection is configured for engaging opposite diametric sides of the insulation coating exposed between the exposed core and the resilient plug.

10. The terminal fitting of claim 9, wherein the projection is configured to surround more than half of a circumference of the insulation coating.

11. The terminal fitting of claim 8, wherein the projection is coupled to at least one of the barrels for movement with at least one of the barrels as the barrels are crimped.

12. The terminal fitting of claim 8, wherein the projection has opposed parts spaced apart by a distance smaller than an outer diameter of the insulation coating so that the insulation coating is pressed into a clearance between the opposed parts before the barrels are crimped.

13. The terminal fitting of claim 8, wherein the projection has a surface substantially perpendicular to a longitudinal direction of the wire.

* * * * *